US005524393A

United States Patent [19]

Nill et al.

[11] Patent Number: 5,524,393

[45] Date of Patent: Jun. 11, 1996

[54] METHOD AND DEVICE FOR DELAYING THE RUN-OFF OF FLASH-STORM WATER OR ORDINARY RAINWATER FROM ROOFS AND OTHER SURFACES WITH WATER-RETENTION CAPABILITY

[75] Inventors: Werner Nill, Eigenheimweg 45, CH-8400 Winterthur, Switzerland; Johannessen Mosbaek, Koge, Denmark

[73] Assignee: Werner Nill, Winterthur, Switzerland

[21] Appl. No.: 196,231

[22] PCT Filed: Jun. 29, 1993

[86] PCT No.: PCT/CH93/00165

§ 371 Date: Feb. 18, 1994

§ 102(e) Date: Feb. 18, 1994

[87] PCT Pub. No.: WO94/00653

PCT Pub. Date: Jan. 6, 1994

[30] Foreign Application Priority Data

Jun. 19, 1992 [CH] Switzerland ..... 2068/92

[51] Int. Cl.[6] ..... E04D 13/00

[52] U.S. Cl. ..... 52/11; 405/52

[58] Field of Search ..... 405/52, 36, 303, 405/127; 210/163–166; 52/11–16

[56] References Cited

U.S. PATENT DOCUMENTS

| | | | |
|---|---|---|---|
| 1,469,303 | 10/1923 | Hess et al. | 210/165 X |
| 2,283,365 | 5/1942 | Heinkel | 210/166 X |
| 2,572,208 | 10/1951 | Sievert | 210/166 |
| 2,618,356 | 11/1952 | Matheis . | |
| 3,198,214 | 8/1965 | Lorenz . | |
| 3,357,561 | 12/1967 | Schmid et al. | 52/12 X |
| 3,469,698 | 9/1969 | Blendermann | 52/12 X |
| 3,529,723 | 9/1970 | Hagedorn | 210/163 |
| 4,034,428 | 7/1977 | Jacuzzi | 210/166 |
| 4,400,272 | 8/1983 | Logsdon . | |
| 4,652,365 | 3/1987 | Ebeling | 52/12 X |

FOREIGN PATENT DOCUMENTS

| | | | |
|---|---|---|---|
| 1006833 | 4/1957 | Germany | 210/166 |
| 1022557 | 1/1958 | Germany | 210/166 |
| 1806527 | 5/1970 | Germany . | |

*Primary Examiner*—Dennis L. Taylor
*Attorney, Agent, or Firm*—Martin A. Farber

[57] ABSTRACT

In order to retain water on the roofs of buildings with a water-retention basin, a vortex-type throttle valve is to be fitted on the flat roof and is to be connected to a drain pipe leading to a drain. The throttle valve makes it possible to control the rainwater run-off at a given rate determined by the size of the throttle valve. If rain falls at a high rate, the excess is retained. Overflow protection is provided by fitting on top of the throttle, a length of pipe which permits the unrestricted flow of water through the throttle valve. Alternatively, the drain pipe can be extended upwards to the maximum permitted water-retention level, thus allowing the water which exceeds this level to pass directly into the drain pipe.

12 Claims, 5 Drawing Sheets

METHOD AND DEVICE FOR DELAYING THE RUN-OFF OF FLASH-STORM WATER OR ORDINARY RAINWATER FROM ROOFS AND OTHER SURFACES WITH WATER-RETENTION CAPABILITY

FIELD AND BACKGROUND OF THE INVENTION

The object of the present invention is a method for delaying the run-off of flash-storm water or ordinary rainwater from roofs and other surfaces with a water-retention capability. The object of the invention is also a device for delaying the run-off of the flash-storm water or ordinary rainwater from roofs and other surfaces with a water-retention capability.

As a result of the intensive building activity in recent years, the sealing of the surfaces in development areas has increased. The flash-storm water falling on the sealed surfaces is thereby no longer slowly taken up naturally by nature but it runs off very rapidly together with a greater or a lesser amount of dirt. This has had the result that the government has taken steps in the case of larger buildings to retain flash-storm water on the spot upon, for instance, heavy rainfalls and/or to delay its further passage or seepage until later.

It has already been proposed, particularly in the case of flat roofs, first to collect the rainwater on the roof and then feed it in throttled fashion to the sewer. In order to compensate for large differences in temperature, a predetermined amount of water is frequently retained permanently on the roof.

In one known embodiment, the cross sections of the pipes leading from the roof to the sewer are correspondingly small so that only the prescribed permissible quantity can flow off.

In that case, to be sure, it is not sufficient merely to dimension the cross sections of the pipes suitably, but the laying of the pipes and their pitch as well as their hydraulic heights are all parameters which must be included in such a calculation. Accordingly, the design and the installation of such a run-off pipe system is very expensive and the positioning of the lines, especially if one proceeds in accordance with the principle of horizontally laid collector lines, frequently results in a high expense and in aesthetic problems within the building.

SUMMARY OF THE INVENTION

The object of the present invention is to provide a method and a device which make it possible, with simple means, to adapt the amount of water flowing to the discharge lines to the capacity of the sewer system and/or of the sewage treatment plant, as well as to the water-retention capability of the structure. Another object is to develop the device in such a manner that the reliability of its operation is not dependent on any other parameters.

By throttling the amount of water which flows to the run-off pipe, it is possible, independently of the lay-out of the pipelines which lead from the roof to the sewer precisely to determine the maximum amount which runs off. Amounts of water which are below the maximum capacity can run off unimpeded at all times. If the amount of water received exceeds the capacity of the throttle member, retention takes place on the roof. If the maximum retention capability of the roof is exceeded, the additionally received water can be conducted away directly, bypassing the throttle, by an emergency run-off pipe which is arranged either in the throttle or separately. The quantity throttle at the inlet to the run-off pipe can be arranged directly in the plane of the roof or above it and need not be arranged in a recessed pot, which can lead to a weakening of the roof or to great difficulties in case of subsequent installation. The discharge lines within the building can be conducted to the most favorable points on the building site and their cross sections need be adapted only to the largest possible amount of water. The vortex-type throttle is not sensitive to clogging and, should foreign bodies nevertheless prevent a controlled discharge, it can be easily cleaned. The expense for the delayed run-off of flash-storm water is slight since no lengthy calculations of the pipe cross sections and expensive laying of the pipes within the building is necessary.

BRIEF DESCRIPTION OF THE DRAWINGS

With the above and other objects and advantages in view, the present invention will become more clearly understood in connection with the detailed description of the preferred embodiments when considered with the accompanying drawings of which.

DETAILED DESCRIPTION OF THE PREFERRED EMBODIMENTS

Figure 1:
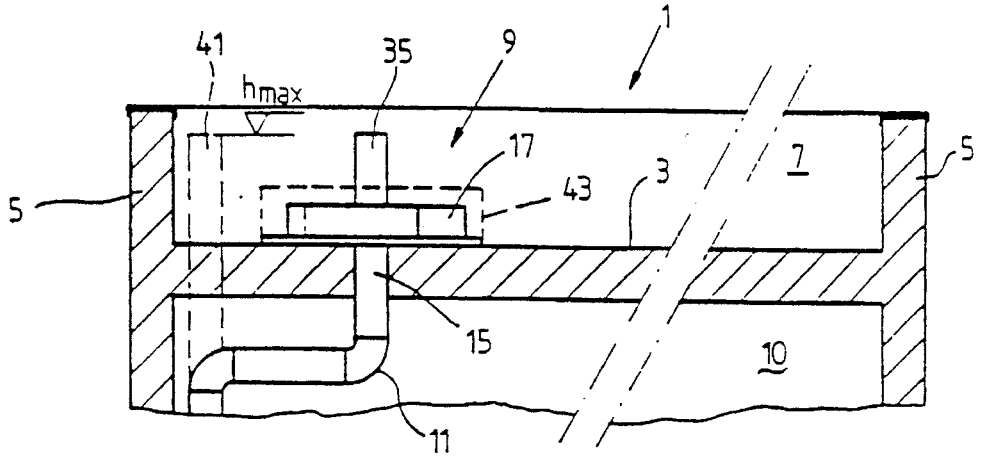
FIG. 1 is a portion of a flat roof with water-retention capability and with a run-off throttle.

The reference numeral 1 in FIG. 1 refers to a portion of the upper part of a building having a flat roof 3 which has laterally upwardly extended masonry sections 5 to form a retention basin 7 for the retaining of rainwater which is temporarily retained during a rainfall. The construction of the flat roof is not shown in detail since it does not constitute an object of the present invention. Nor is there shown in the drawing the inclination of the roof 3 which causes the water collecting on it to flow to an outlet 9 from which it can feed by a drain pipe 11 ordinarily present in the building 10 to a sewer line (not shown) buried in the ground, or to a drain.

Figure 4:
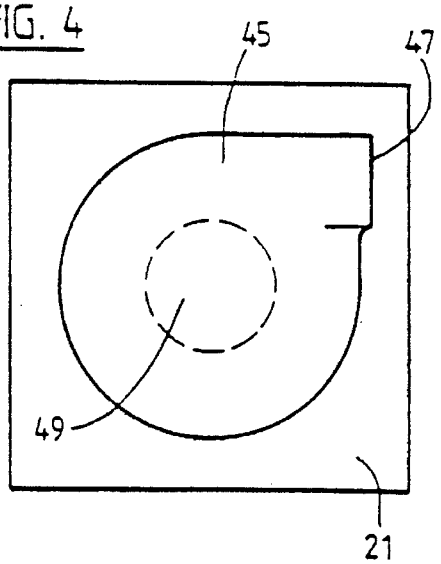
FIG. 4 shows another embodiment of the device for delayed run-off, in a top view.
Figure 5:
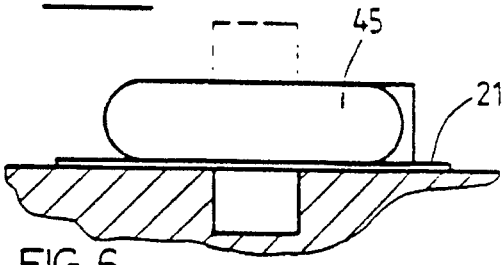
FIG. 5 is a side view of the device shown in FIG. 4.
Figure 6:
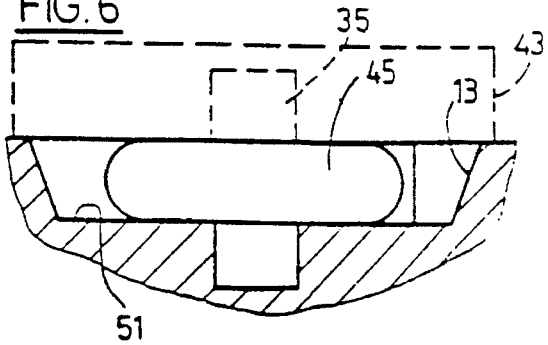
FIG. 6 shows the arrangement of the device of FIGS. 4 and 5 in an inlet basin.

In the examples shown in FIGS. 1 to 5, the outlet 9 is flush with the upper edge of the roof so that no weakening of the roof takes place in the region of the outlet 9 by a collecting basin, such as shown, for instance, in FIG. 6.

Figure 2:
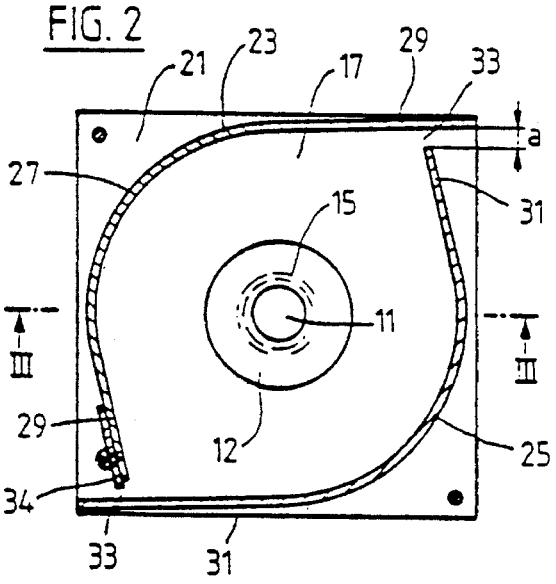
FIG. 2 is a section along the line II—II of FIG. 3 of the device for the delayed run-off of the roof water.
Figure 3:
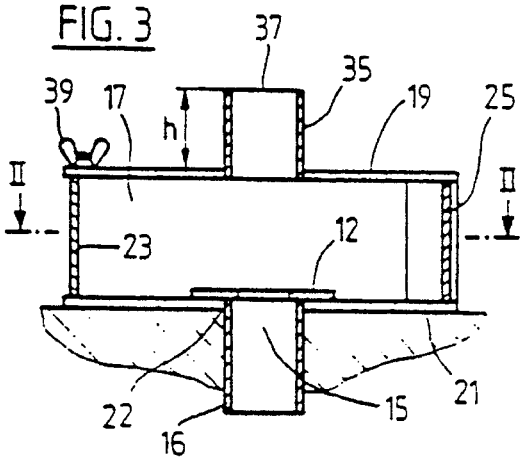
FIG. 3 is a cross section along the line III—III through the device shown in FIG. 2.

On the upper end 15 of the drain pipe 11 which passes through the flat roof 3 there is present a vortex throttle 17 which, in the example shown in FIGS. 1 to 3, consists of two plates 19 and 21 which are arranged parallel to each other, the two plates 19, 21 being connected to each other by two arcuate vertically standing guide plates 23 and 25. Each of the two plates 23 and 25 comprise a fourth part of the circumference and, adjoining same, a linear section. Between one end in each case of the linear section 31 and one end of the linear section 29 there is a slot or opening 33 of the width a. The slot-shaped openings 33 and the two plates 19 and 21 form an inlet for the feeding of the water to the drain pipe 11 which is located in the center of the vortex throttle 17 and connects upon a pipe socket 16. In the lower plate 21 there is accordingly arranged a corresponding recess 22 which is connected to the upper end 15 of the drain pipe 11. A replaceable run-off diaphragm 12 having a pipe part 16 can be placed on or inserted in the recess 22 and by means of it the maximum run-off quantity passing through can furthermore as well as subsequently be adjusted or changed.

A pipe socket 35 of the height h can also be placed in the upper plate 19, it forming a direct connection into the inside of the vortex throttle 17 and lying coaxial to the upper end 15 of the drain pipe 11. The upper edge 37 of the pipe socket 35 lies at the height $h_{max}$, which corresponds to the maximum retention height in the retention basin 7.

Figure 13:
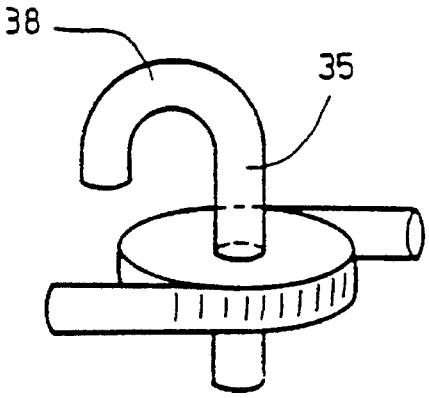
FIG. 13 is a vortex throttle such as shown in FIG. 12. with siphon-like emergency overflow.
Figure 14:
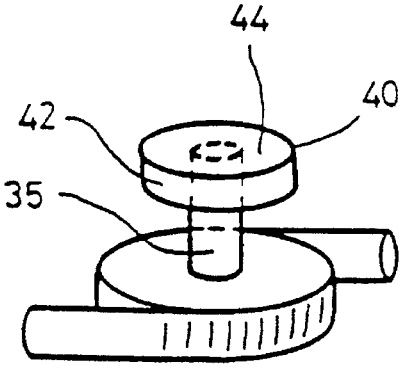
FIG. 14 is a vortex throttle having an emergency overflow which is covered by an immersion body.

In order to protect against foreign substances which float on the collected retained water and might clog the vortex throttle, a semicircular length of pipe 38 such as shown for instance in FIGS. 13 and 14 or an immersion bell 40 such as shown for instance in FIG. 14 can be placed on the upper end of the pipe socket 35. The immersion bell 40 has an outer wall 42 and a cover section 44. Between the upper end of the pipe 35 and the cover section 44 there is a slot corresponding at least to the cross section of the pipe 35. Foreign substances floating on the surface of the water are held back by the wall surface 42 and the water can flow below the wall 42 into the pipeline 35.

The vortex throttle 17 may be made of steel or plastic. In a preferred embodiment, the upper plate 19 can be lifted off for instance by loosening wing nuts 39 which are arranged on corresponding screw bolts which are passed through the plate and arranged on the vertical plates 23 and 25, so as to permit cleaning of the inside of the vortex throttle 17.

Figure 7:
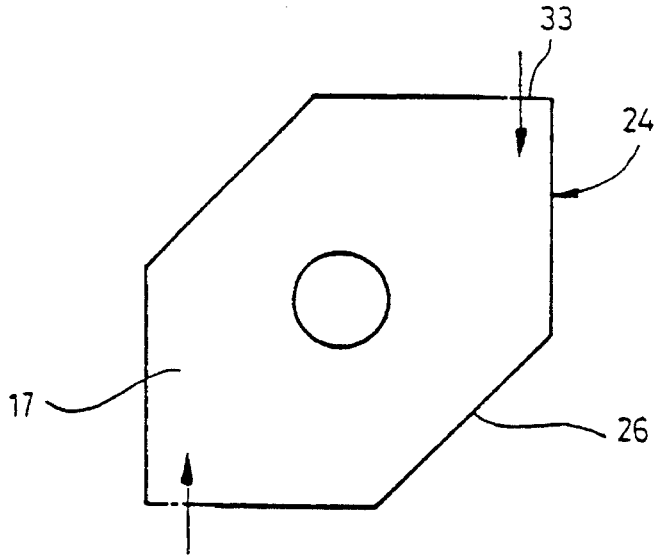
FIG. 7 is a horizontal cross section through an alternative embodiment of the vortex throttle formed of bent sheet-metal parts.
Figure 8:
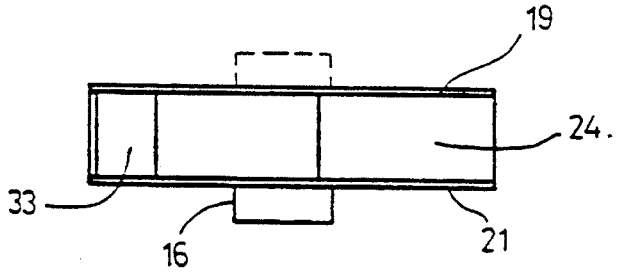
FIG. 8 is a front view of the vortex throttle shown in FIG. 7.
Figure 9:
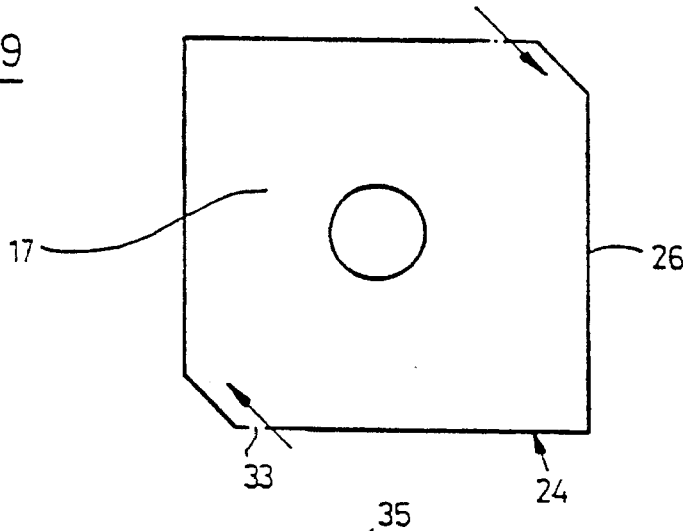
FIG. 9 is a horizontal cross section through an alternative embodiment of the vortex throttle consisting of bent sheet-metal parts.
Figure 10:
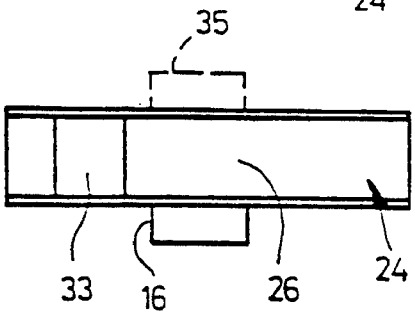
FIG. 10 is a front view of the vortex throttle of FIG. 8.

Instead of arcuate guide plates 23, singly or multiply bent guide plates 24, 26 or guide plates welded together from sections can be connected, in the manner described, to the two plates 19 and 21. In FIGS. 7 and 8 the guide plates 24 are each bent twice and have linearly extending sections 24, 26. The openings 33 can be developed fixed or, as shown in FIG. 2, variable (no illustration).

When there is only a slight flow of water, i.e. upon a light rain, all the entering water can pass continuously through the openings 33 into the inside of the vortex throttle 17 and from there through the pipe 11 into the sewer.

As soon as the amount of water arriving becomes greater, revolving water vortices are formed within the vortex throttle 17, they limiting the discharge as a function of the cross section a of the opening 33 and the development of the two vertically bent plates 23 and 25 or the plates 24 in FIGS. 7 to 10 and the cross section of the drain pipe 11 or of the discharge diaphragm 12 possibly arranged over it. In this way, the excess water arriving is stored above the vortex throttle 17 in the retention basin 7 and a constant amount discharges at all times. If the water level exceeds the height $h_{max}$ so that there is the danger of an overflooding of the roof, water can pass directly through the pipe socket 35 from above, through the vortex throttle 17 to the drain pipe 11 and from there, for instance, into the sewer. Instead of a pipe socket 35 placed on the vortex throttle 17 as emergency relief or overflow, a length of pipe 41 (shown in broken line in FIG. 1) which terminates at the same height can also be connected directly to the drain pipe 11 or to an additional pipe leading to the sewer (not shown).

Figure 15:
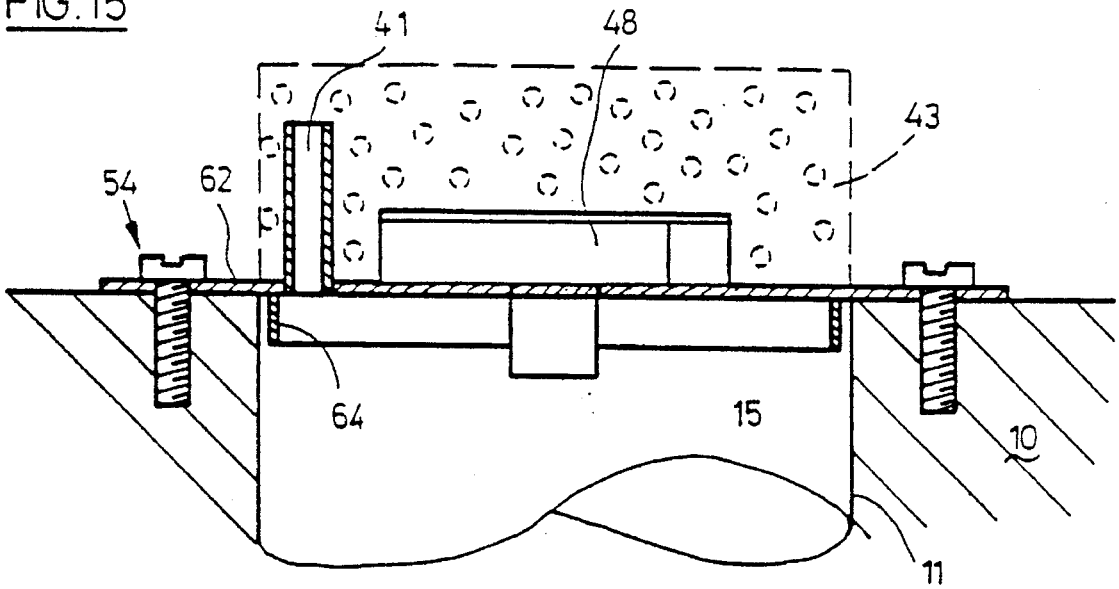
FIG. 15 is a cross section through a vortex throttle installed in an adapter and placed on an existing discharge opening (vortex throttle shown in front view).

In order to prevent a clogging of the slot 33, the entire vortex throttle 17 is preferably surrounded by a removable grate 43. The grate 43 can surround the vortex throttle 17 completely on its sides and on top (FIG. 1) or it can be developed as a round or rectangular basket 48 which is open on top (FIG. 15).

In order to get along with only a slight number of vortex throttles 17 in stock, it is possible, with a small maximum amount of run-off and a vortex throttle 17 which is dimensioned too large for the amount of water to be led away, at least one of the openings 33 can be closed by a cover (not shown) or be reduced in size or closed by the displaceable slide 34 (FIG. 2).

In the embodiment according to FIGS. 4 to 6, instead of the vortex throttle consisting of two bent plates 25, 27 and two plates 19 and 21 lying spaced one above the other, there is used a cylindrical vortex throttle 45 of known construction, such as used in catch basins, in which the water enters through a tangentially debouching inlet opening 47 and can discharge, throttled, through the central discharge opening 49. The manner of operation of the vortex throttles 45 shown in FIGS. 4 to 6 is identical to those in FIGS. 1 to 3. These vortex throttles 45 can also be protected against dirt by a basket or grate 43.

The vortex throttles 17, 45 can also be inserted directly in a gravel bed on the flat roof 3.

The manner of operation of vortex throttles is described for instance in U.S. Pat. No. 3,198,214. Therefore, no further description is given here with regard to the manner of operation and the design of vortex throttles. As an alternative to the vortex throttles 17, 45 which are placed directly on the surface of the flat roof 3, they can of course also be arranged within a sump 55 recessed in the flat roof 3 (FIG. 6).

Figure 11:
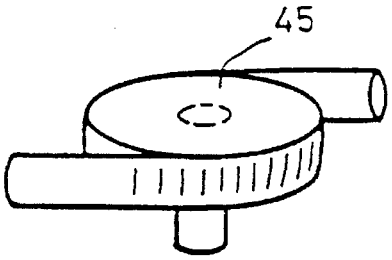
FIG. 11 is a vortex throttle with tangential inlets in the same direction, without emergency overflow through the vortex throttle.
Figure 12:
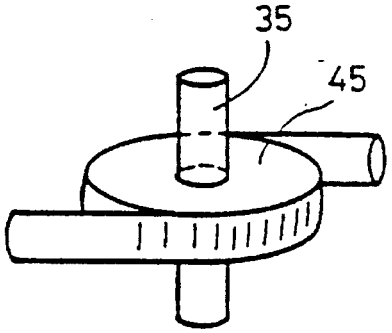
FIG. 12 is a vortex throttle having two inlets directed in the same direction and an emergency overflow.

For a temporary retention of rainwater which arrives in larger quantity than can be taken up by the sewage treatment plant, a vortex throttle 45, such as shown in FIG. 11, can also be used. This vortex throttle 45 does not have an emergency overflow passing through it; rather, the latter must be provided independently and at some other place on the roof. In the developments of the vortex throttles shown in FIGS. 12, 13 and 14, emergency overflow pipes 35 are provided which are arranged coaxial to the throttle 45. In the simplest embodiment, shown in FIG. 12, the emergency overflow line is open on top. In the embodiment according to FIG. 13, a semi-circular elbow 52 is placed on the end of the pipe socket 35 of the emergency overflow line, it preventing foreign substances which float on the surface of the retained water from passing into the emergency overflow line and clogging it.

In the event of the subsequent installation of a vortex throttle 17 on the roof of an existing building 10 in the case of which the upper end 15 of the drain pipe 11 has a substantially larger cross section than the diameter of the discharge-side opening on the vortex throttle 17, the latter can be fastened to an adapter 54 which consists of a plate 62 to which a collar 64 is fastened and can be inserted into the upper end 15 of the pipe 11 (FIG. 15).

Figure 16:
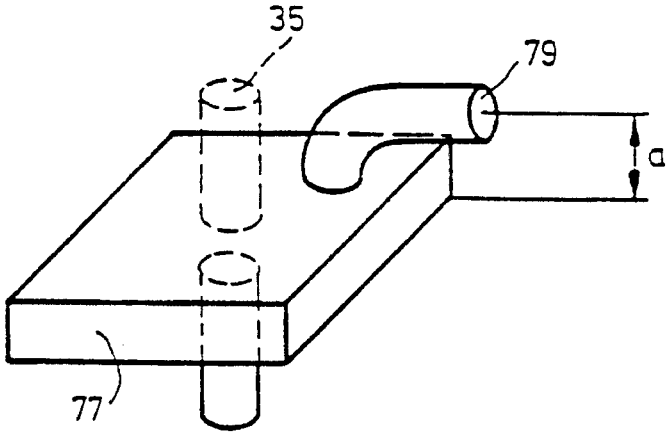
FIG. 16 is a perspective showing of a vortex throttle over which there is an inlet, seen from above.

The vortex throttle 77 shown diagrammatically in FIG. 16 has in inlet 79 which debouches into the upper cover surface. This vortex throttle 77 can be used either in a sump, as shown in FIG. 6, or on a roof with continuous retention of the height a.

Figure 17:
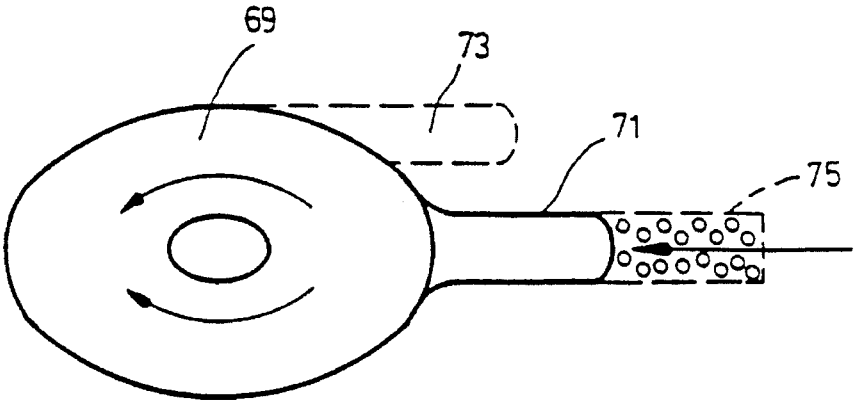
FIG. 17 shows the contour of a vortex throttle with radial inlet and tangential inlet (tangential inlet shown in dashed line).

The vortex throttle 69 shown in FIG. 17 can be provided with a radial inlet socket 71 or have, in addition, a tangential inlet 73. The tangential inlet 73 can be located at a higher level than the inlet socket 71. This makes it possible, in the event of the possible clogging of the lower inlet 71, for it to act as emergency inlet with throttling properties. In front of the lower inlet 71, instead of a grate 43 which surrounds the entire vortex throttle 69 as shown in FIG. 1, a strainer 75 can be provided. The strainer 75 consists in this case of a tubular section which is closed at its end and is made from perforated plate or of grid-shaped material. The use of the vortex throttle 69 shown in FIG. 17 is similar to those already described.

Figure 18:
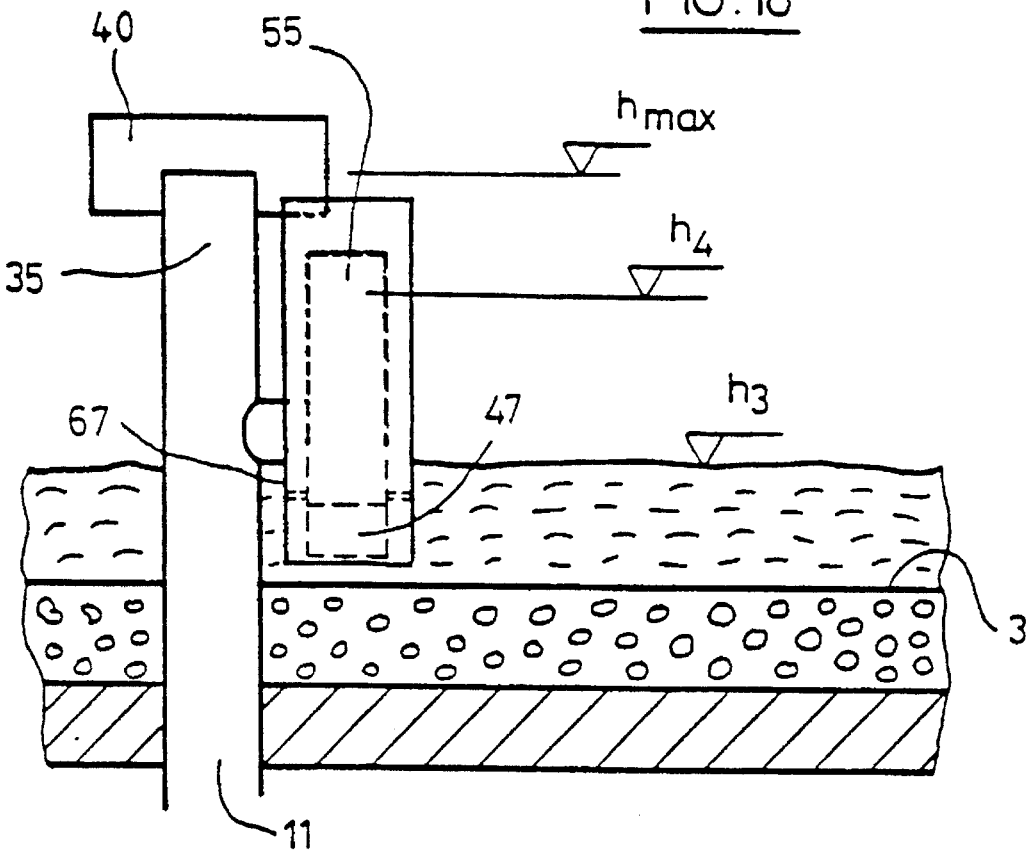
FIG. 18 shows a portion of a flat roof having permanent retention and a vertically arranged vortex throttle.

In the case of flat roofs 3 with permanent retention of water up to the height $h_3$ (see FIG. 18 the outlet-side opening of the vortex throttle 55 is arranged above the height $h_3$. The vertically arranged vortex throttle 55 may have a development corresponding to the vortex throttle 45 shown in FIG. 4, the water inlet opening 47 being located below the height $h_3$. Of course, a vortex throttle 17, such as shown in FIGS. 2, 7, 8 and 9 could also be used if one of the two inlet openings, namely the upper one, is closed. The emergency overflow line 35 is arranged in the vertical extension of the drain pipe 11 and can have a hood or immersion bell 40, as described and shown in FIG. 14, in order to prevent the admission of foreign substances floating on the water. An immersion wall 67 can also be arranged around the inlet 47 of the vortex throttle 55. The immersion wall 67 consists of vertical metal sheets or plastic plates which prevent the introduction of floating foreign objects into the water inlet opening 47.

In the event of only slight amounts of rain, the water collecting on the roof 3 can pass through the immersed inlet opening 47 unthrottled into the drain pipe 11 and from there into the sewer. However, if the level rises above the height $h_3$ up to the height $h_4$, which lies above the top of the outlet-side opening of the vortex throttle 55, then vortices are formed in the vortex throttle 55 and limit the passage of water to the extent pre-established by the development of the vortex throttle 55. Accordingly, there is a rise in the water level with constant throttled discharge up to the height $h_{max}$. If the water level rises further due to intense rainfalls, water can be fed unthrottled through the emergency overflow line 35 to the drain pipe 11. As an alternative, it is also possible to conduct the emergency overflow water to a pipe, not shown here, which discharges directly into a waterway, circumventing a sewage treatment plant.

Figure 19:
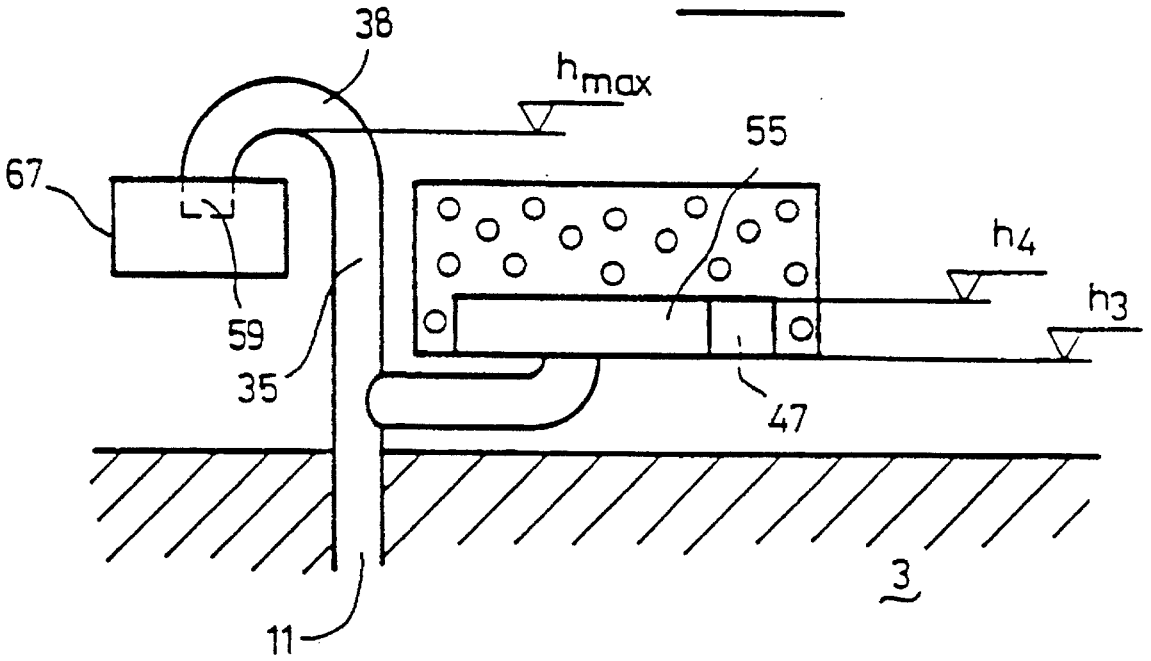
FIG. 19 is an alternative embodiment of a horizontally arranged vortex throttle for a flat roof with permanent retention.

In the development of the invention according to FIG. 19, which shows the arrangement of the individual parts only diagrammatically, the vortex throttle 55 or its outlet-side opening 47 lies at the height $h_3$ which corresponds to the intended height of the continuous retention. Upon a further increase of the water level, the water can flow unthrottled to the drain pipe 11 as long as the level does not exceed the height $h_4$. If the height $h_4$ is exceeded, then the action of the vortex throttle 55 commences, i.e. the water which flows from now on to the vortex throttle 55 is discharged in the amount determined by the development of the vortex throttle 55, which amount cannot be exceeded. Upon a further rise above the height $h_{max}$, the water can discharge via the emergency overflow line. The front end 59 of the emergency overflow line 35 which dips into the water level $h_{max}$, in its turn, prevents floating foreign bodies from entering into the drain pipe 11 and clogging it.

If the vortex throttle 55 in the embodiment of the invention shown in FIG. 19 is arranged at the level of the roof 3, its manner of operation corresponds to that shown in FIG. 1.

We claim:

1. A device for the delayed run-off of flash-storm water or ordinary rainwater from a roof or other surface with water-retention capability for sporadic or permanent retention, the device comprising:

a throttle element, a drain pipe having a roof-side inlet in fluid communication with the throttle element;

wherein said throttle element has an outer wall encircling an axis of said drain inlet for guiding incoming water into a vortex flow pattern about said axis, said throttle element further comprising an inlet port disposed in said outer wall and being oriented relative to said outer wall for directing the incoming water against an inner surface of said outer wall for development of said vortex flow pattern; and said outer wall is spaced apart from said pipe in a radial direction from said axis to provide a vortex diameter of said flow pattern which is larger than a cross sectional dimension of said pipe and enabling a vortex of said flow pattern to perform a throttling function to limit a rate of flow of said incoming water into said pipe at a maximum vortex flow rate, said maximum vortex flow rate being less than a laminar rate of flow of the rainwater into said pipe.

2. A device according to claim 1, wherein said pipe is located relative to said throttle element to serve as a central outlet, and said inlet port is a tangential inlet port.

3. A device according to claim 1, wherein said outer wall comprises two curved plates arranged symmetrically about said axis, and said throttle element further comprises two plates which lie substantially parallel to each other and are connected together by said curved plates; and wherein said inlet port is a slot between ends of said curved plates, a curvature of said plates being characterized as an arcuate section or a bent-off section.

4. A device according to claim 3, wherein said curved plates include an upper plate and a lower plate, the device further comprising a pipe part which leads to the drain pipe and is secured to said lower plate.

5. A device according to claim 4, further comprising a pipe socket for introduction of water exceeding a maximum retention height into said throttle element, said pipe socket being disposed in said upper plate.

6. A device according to claim 4, wherein said upper plate is removable;

the device further comprising a diaphragm located on the drain inlet of said drain pipe.

7. A device according to claim 3, further comprising a slide for varying a width of said inlet-port slot.

8. A device according to claim 5, further comprising an immersion bell disposed on an end of said pipe socket for a retaining of floating foreign bodies.

9. A device according to claim 5, further comprising a pipe bend disposed on an end of said pipe socket for a retaining of floating foreign bodies.

10. A device according to claim 1, further comprising means for elevating said drain inlet above a surface of the roof at a height of a permanent retention of water on the roof.

11. A device according to claim 10, wherein said throttle element is secured in a horizontal altitude to said drain pipe.

12. A device according to claim 10, wherein said throttle element secured in a vertical altitude to said drain pipe.

* * * * *

UNITED STATES PATENT AND TRADEMARK OFFICE

CERTIFICATE OF CORRECTION

PATENT NO. : 5,524,393

DATED : June 11, 1996

INVENTOR(S) : Werner Nill, et al

It is certified that error appears in the above-identified patent and that said Letters Patent is hereby corrected as shown below:

On the cover page left side in the second line of item [30] "Jun. 19, 1992" should be --Jun. 30, 1992--

Signed and Sealed this

Twenty-eighth Day of October, 1997

Bruce Lehman

*Attest:*

BRUCE LEHMAN

*Attesting Officer*

*Commissioner of Patents and Trademarks*